US005282753A

United States Patent [19]

Su

[11] Patent Number: 5,282,753

[45] Date of Patent: Feb. 1, 1994

[54] INNER PIN BASE FOR A THREE-POLE PLUG

[76] Inventor: Tun-Li Su, No. 90, Chung Cheng Road, Lu-Chu, Kaohsung County, Taiwan

[21] Appl. No.: 48,469

[22] Filed: Apr. 16, 1993

[51] Int. Cl.[5] ..... H01R 13/504

[52] U.S. Cl. ..... 439/106; 439/695

[58] Field of Search ..... 439/106, 606, 695, 686

[56] References Cited

U.S. PATENT DOCUMENTS 3,611,257 10/1971 Carkhuff ..... 439/606

FOREIGN PATENT DOCUMENTS 1515438 8/1969 Fed. Rep. of Germany ..... 439/106

*Primary Examiner*—Gary F. Paumen

*Attorney, Agent, or Firm*—Pro-Techtor International

[57] ABSTRACT

The present invention relates to an inner pin base for a three-pole plug. The inner pin base has a round-sectional passageway at a top portion and two channels at two sides of a bottom portion. An upper and a lower rims of the passageway extend backward to form an upper and a lower tongue pieces, respectively, allowing a ground terminal to pass through while a projected portion on a top surface of the lower tongue piece engages with an oval hole at the end of the ground terminal passing therethrough. The channels each has a vertical and slender slot formed at their substantially closed front end, allowing a positive or a negative terminal to pass through. Two parallel stops extend backward from two internal sides of each vertical and slender slot and each has two vertically spaced projected portions inwardly extending toward the slender slot such that the vertically spaced projected portions of the parallel stops engage with recesses formed on the positive and/or the negative terminals when the terminals are separately inserted through the vertical and slender slots. In this manner, the inner pin base allows convenient assembly of the terminals and provides considerable strength to hold the assembled terminals so that the inner pin base along with the assembled terminals may be directly positioned in a mold for injection molding to form a finished three-pole plug.

1 Claim, 7 Drawing Sheets

INNER PIN BASE FOR A THREE-POLE PLUG

BACKGROUND OF THE INVENTION

It is known that three-pole plugs and associated sockets are safe in use and therefore, they are now widely used in the connection of various kinds of electric appliances. FIG. 6 illustrates one of the commonly adopted three-pole plugs of which the inner structure can be clearly seen from the drawing. Such a conventional three-pole plug usually comprises an inner pin base member 6 and an outer protective housing member 7 fitly covering the inner pin base member 6. The inner pin base member 6 has a concave top 61 from an adequate point of there a cotter 62 suitable for engaging with an opening 31 at the end of a round-sectional ground terminal 3 upwardly projects. The inner pin base member 6 further has two side fixing blocks 63 suitable for separately engaging with end recesses 41, 51 of a positive terminal 4 and a negative terminal 5, respectively. The outer protective housing member 7 has two longitudinally extended and upward projected flanges 71 which are suitable for engaging with two corresponding grooves 64 formed at a bottom side of the inner pin base member 6. With the assembly of the outer protective housing member 7 and the inner pin base member 6 by engaging the flanges 71 with the grooves 64, the pre-assembled ground, positive, and negative terminals 3, 4, 5 are firmly fixed in place within the protective housing member 7. The assembled inner pin base member 6 and the outer protective housing member 7 must be wrapped with insulating material through injection molding so as to form the common three-pole plug as shown in FIG. 5.

In a further study of the above-mentioned manufacturing process and the structure of a conventional three-pole plug, it is found that the ground, the positive, and the negative terminals 3, 4, 5 are manually mounted on the inner pin base member 6, and then, the outer protective housing member 7 is manually put over to house the assembled terminals and inner pin base member 6. For an experienced and skilled operator, it might not be so difficult to complete this two-stage assembly, except a longer time is required. However, for an unexperienced operator, such assembly would be not only a time-consuming but also a labor-consuming work. Moreover, the assembled inner pin base member 6 must be housed with a protective housing member 7 which apparently increases the production cost due to additional material used to make the protective housing member 7.

SUMMARY OF THE INVENTION

A primary object of the present invention is to provide an inner pin base member for three-pole plugs, allowing the plugs to be produced in an more efficient manner and at lower production cost and are therefore suitable for mass production.

A further object of the present invention is to provide an inner pin base member for three-pole plugs, in which the ground, positive, and negative terminals can be more conveniently and more firmly assembled.

A still further object of the present invention is to provide an pin base member for three-pole plugs which does not require a protective housing and may be directly wrapped with insulating material through injection molding to form a plug.

BRIEF DESCRIPTION OF THE DRAWINGS

The structure of the present invention and the technical means adopted to achieve it, as well as the other objects of the invention may be best understood through referring to the following detailed description of the preferred embodiments and the accompanying drawings wherein.

DETAILED DESCRIPTION OF THE PREFERRED EMBODIMENTS

Figure 1:
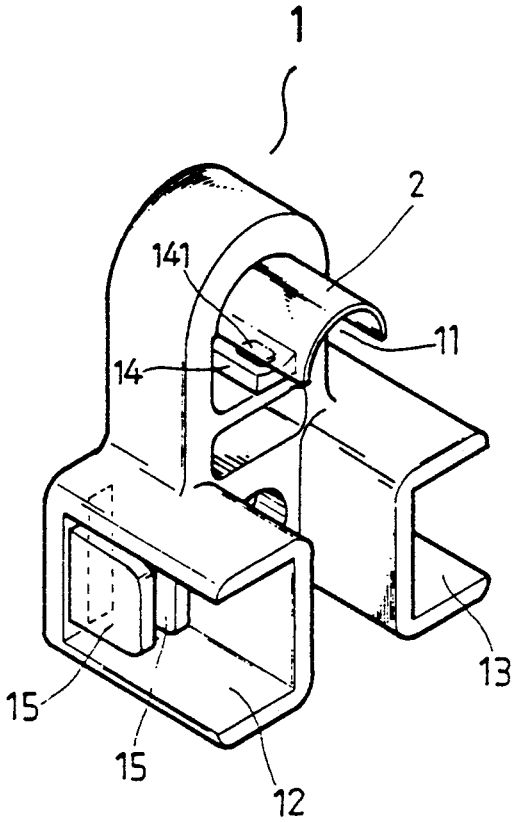
FIG. 1 is a three-dimensional perspective of the inner pin base member according to the present invention.
Figure 2:
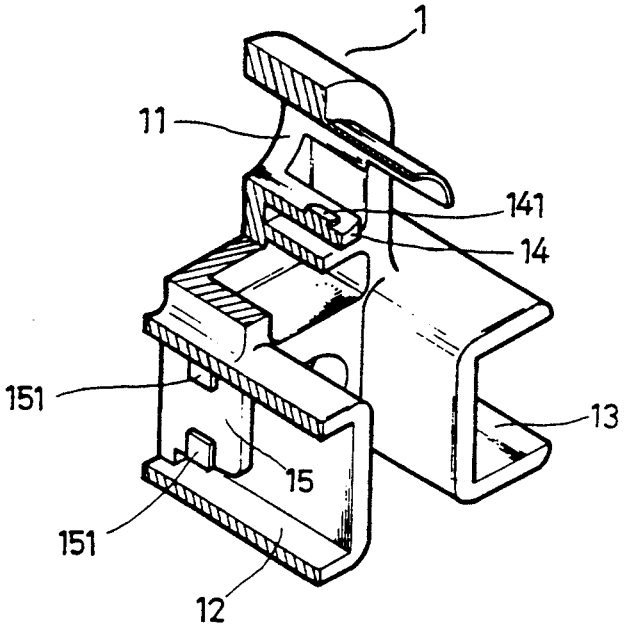
FIG. 2 is a fragmentary perspective of the present invention shown in FIG. 1 to show the internal structure thereof.
Figure 3:
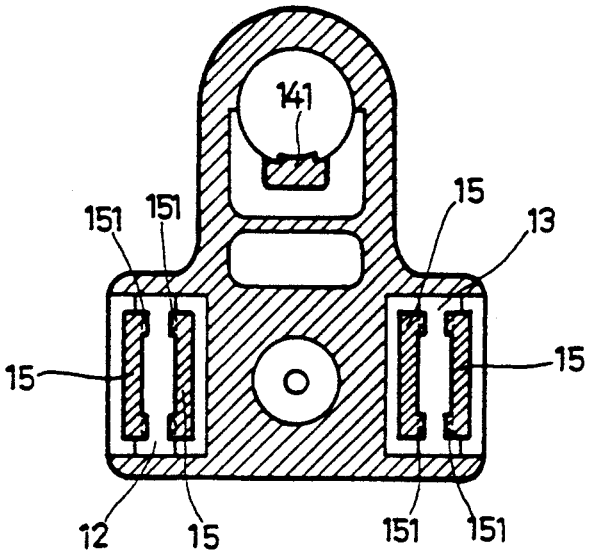
FIG. 3 is a vertically sectional view of FIG. 1.

Please refer to FIGS. 1, 2, and 3. An inner pin base member 1 according to the present invention is mainly an injection molded plastic article and has a round-sectional passageway 11 at its top portion. The passageway 11 has an upper rim which extends backward for a certain length and thereby forms an upper tongue piece 2. The passageway 11 also has a bottom rim which extends backward for a certain length and thereby forms a lower tongue piece 14. The lower tongue piece 14 has an upward projected portion 141 which engages with an oval hole 31 on a ground terminal 3 when the same is inserted through the passageway 11. The inner pin base member 1 also has two channels 12, 13 separately disposed at each lower side of the pin base member 1. The channels 12, 13 each has an open rear end and a substantially closed front end having only a centered vertical and slender slot 121 or 131 formed thereon to allow a positive terminal 4 or a negative terminal 5 to pass therethrough. The vertical slender slots 121, 131 each has two parallel and backward extended stops 15 one at each side. Each of the stops 15 has two vertically spaced projected portions 151 formed at adequate positions and inwardly extending toward the vertical slender slot 121 or 131 such that the projected portions 151 firmly fix the positive or the negative terminal 4 or 5 inserted through the vertical slender slots 121, 131 by engaging with corresponding recesses 41 or 51 on the positive or the negative terminal 4 or 5, respectively.

Figure 4:
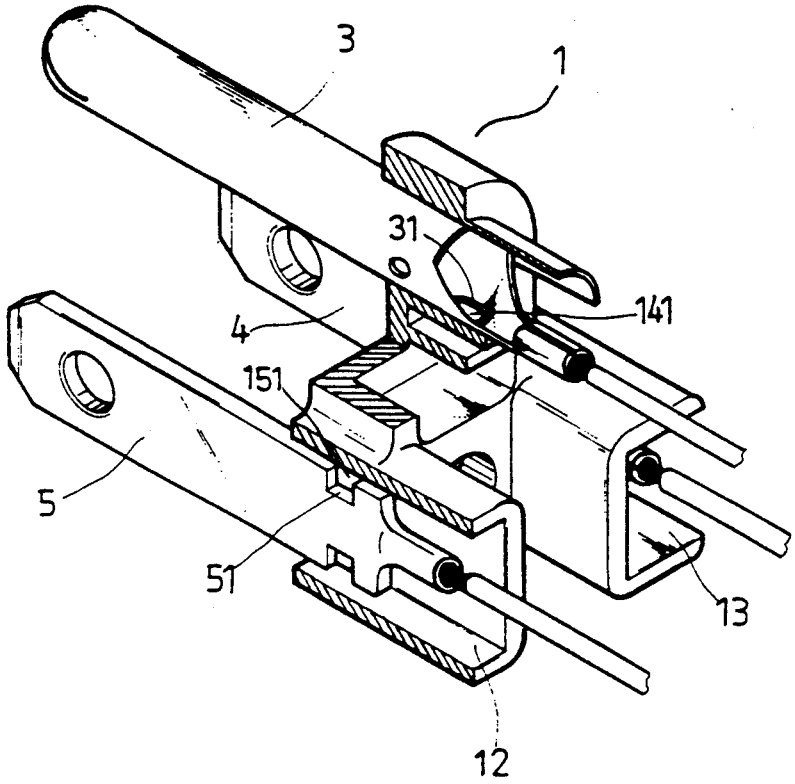
FIG. 4 is a fragmentary perspective of the present invention with assembled ground, positive, and negative terminals.

Please refer to FIG. 4 for the manner in which the terminals 3, 4, and 5 are assembled to the inner pin base member 1 of the present invention. To assemble the terminals, first insert the ground terminal 3 through the passageway 11, allowing the oval hole 31 at rear end of the ground terminal 3 to engage with the upward projected portion 141 on the lower tongue piece 14. Then, insert the positive and negative terminals 4, 5, through the vertical slender slots 121, 131 via the channels 12, 13, respectively, until the recesses 41, 51 near rear end of the positive and the negative terminals 4, 5, respectively, engage with the corresponding projected portions 151 at inner side of the stops 15. The ground terminal 3, being supported and surrounded by the upper tongue piece 2, the lower tongue piece 14 and held by the engagement of the projected portion 141 of the lower tongue piece 14 with the oval hole 31 of the ground terminal 3, is firmly confined in place in the passageway 11. Similarly, the positive and the negative terminals 4, 5, being supported and confined by the vertical slender slots 121, 131 and the channels 12, 13 within their upper and lower walls and held in place by the engagement of the recesses 41, 51 with the corresponding projected portions 151, are therefore firmly retained on the inner pin base member 1.

Figure 5:
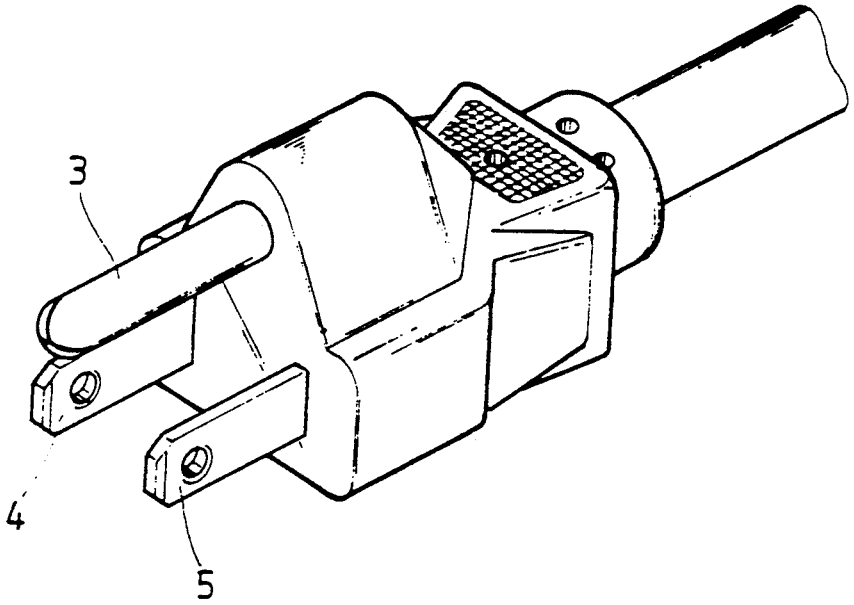
FIG. 5 shows a finished three-pole plug.
Figure 6:
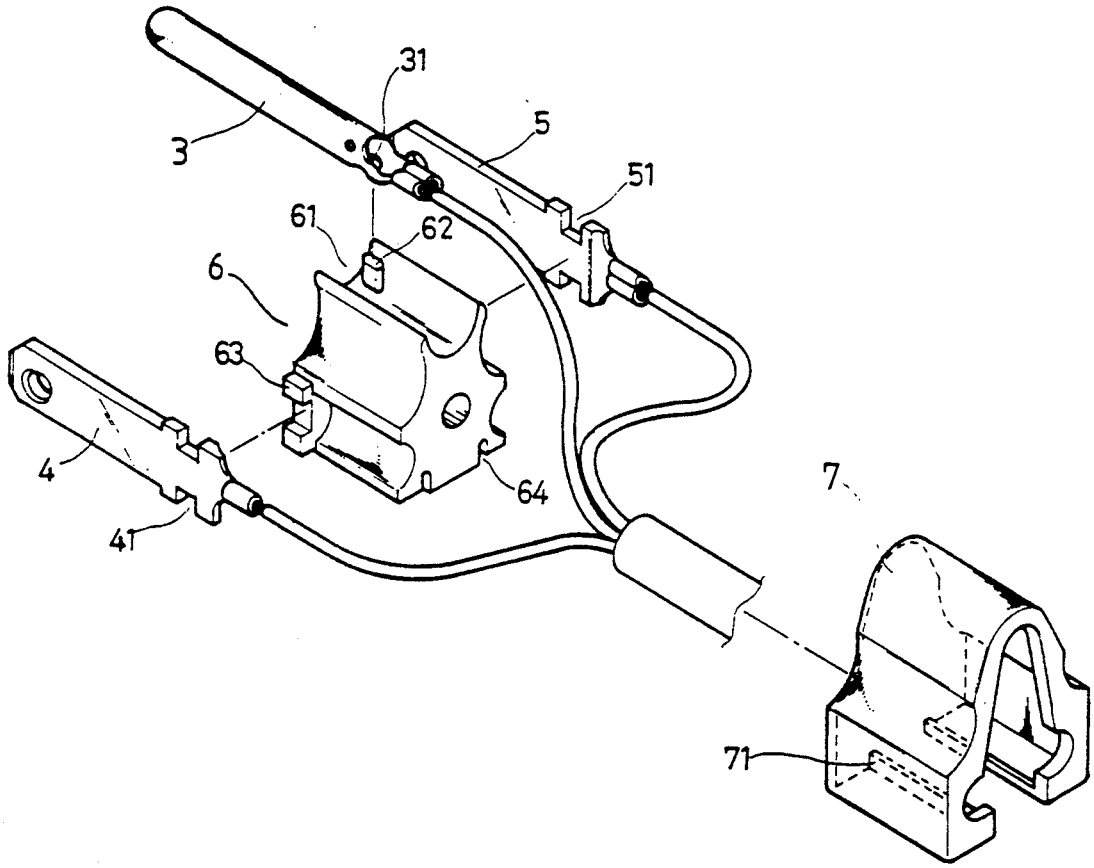
FIG. 6 PRIOR ART
FIG. 6 is a disassembled conventional three-pole plug.
Figure 7:
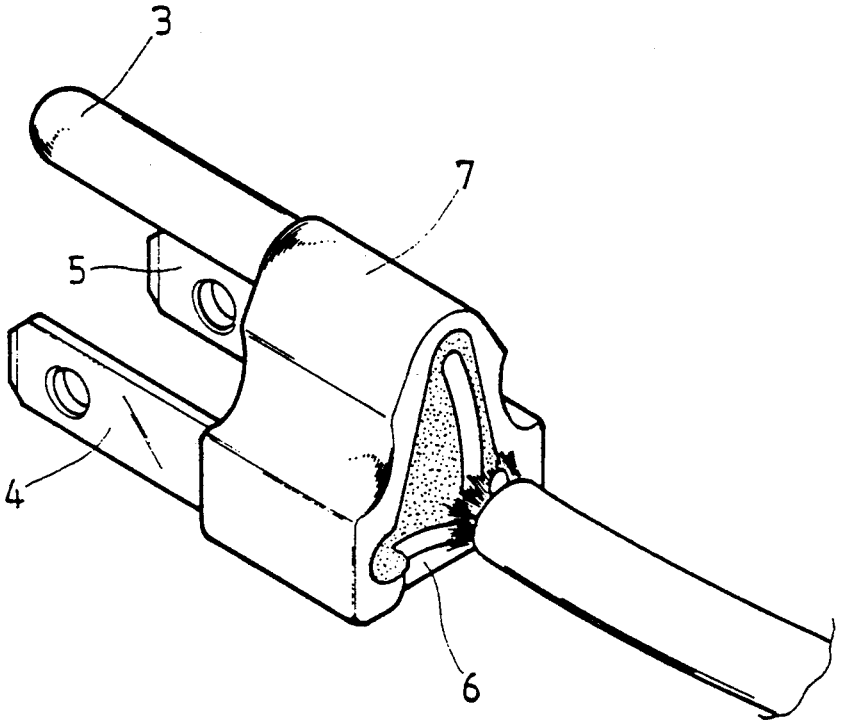
FIG. 7 PRIOR ART
FIG. 7 shows a half-finished conventional three-pole plug with the inner pin base member housed by a protective member.

Since the structure of the inner pin base member 1 of the present invention provides considerably strong support to the assembled ground terminal 3, positive terminal 4, and negative terminal 5, no further outer protective housing member is required to wrap the assembled inner pin base member 1. That is, the inner pin base member 1 with assembled terminals may be positioned in a mold for direct injection molding to form a three-pole plug as shown in FIG. 5.

The advantages of the present invention lie in the manner in which the inner pin base member 1 supports and connects the terminals that enhances the convenience in assembling the terminals and the strength provided by the pin base member to holding the terminals, and in the fact the pin base member and the assembled terminals may be directly put into a mold for injection molding that saves not only the time needed in the production but also the material cost needed to make other protective housing. In brief, the inner pin base member of the present invention is helpful and practical in producing the three-pole plugs in a more efficient and economical manner.

What is claimed is:

1. An inner pin base for a three-pole plug, comprising:

a round-sectional passageway at a top portion of said inner pin base, said passageway having an upper rim which extends backward to form an upper tongue piece, and a lower rim which extends backward to form a lower tongue piece, said lower tongue piece having an upward projected portion formed on a top surface of said lower tongue piece, and said projected portion of said lower tongue piece being suitable for engaging with an oval hole formed on a round ground terminal being inserted through said passageway; and two channels separately disposed at two sides of a lower portion of said inner pin base, said channels each having an open rear end and a substantially closed front end, each said closed front end having a vertical and slender slot formed thereon such that said slender slot allows a flat positive or negative terminal to pass through, said vertical and slender slots each having two parallel stops separately extending backward from two internal sides of said vertical and slender slot, each of said parallel stops having two vertically spaced projected portions inwardly extending toward said slender slot, and said vertically spaced projected portions of said parallel stops being suitable for engaging with recesses correspondingly formed on said positive or negative terminal being inserted through said vertical and slender slot.

* * * * *